US009874838B1

(12) United States Patent
Cao

(10) Patent No.: US 9,874,838 B1
(45) Date of Patent: Jan. 23, 2018

(54) SYSTEM AND METHOD FOR CONTROLLING A FUSER ASSEMBLY OF AN ELECTROPHOTOGRAPHIC IMAGING DEVICE

(71) Applicant: Lexmark International, Inc., Lexington, KY (US)

(72) Inventor: Jichang Cao, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 18 days.

(21) Appl. No.: 15/222,138

(22) Filed: Jul. 28, 2016

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS 4,001,545 A * 1/1977 Wada ..... G03G 15/2042 100/328
5,376,773 A * 12/1994 Masuda ..... G03G 15/2003 219/216
5,640,231 A * 6/1997 Mitsui ..... G03G 15/2003 219/216
5,915,146 A * 6/1999 Kusaka ..... G03G 15/2003 219/216
6,185,383 B1 * 2/2001 Kanari ..... H05B 3/0095 219/216
6,336,009 B1 * 1/2002 Suzumi ..... G03G 15/2042 399/67
7,228,082 B1 * 6/2007 Davidson ..... G03G 15/2064 399/329
9,448,514 B2 * 9/2016 Ikebuchi ..... G03G 15/2042
2002/0094212 A1 * 7/2002 Suzumi ..... G03G 15/2042 399/69
2004/0190924 A1 * 9/2004 Iwasaki ..... G03G 15/657 399/68
2004/0232137 A1 * 11/2004 Cook ..... H05B 1/0205 219/486
2007/0025750 A1 * 2/2007 Ando ..... G03G 15/2032 399/67
2007/0088963 A1 * 4/2007 Nakaya ..... G03G 15/2039 713/300
2007/0122173 A1 * 5/2007 Mitsuoka ..... G03G 15/2039 399/69

(Continued)

*Primary Examiner* — David Bolduc

(57) ABSTRACT

An apparatus includes a fuser assembly including a heat transfer member. The heat transfer member includes a substrate, first and second resistive traces disposed on the substrate, and a temperature sensor disposed on the substrate for sensing an end portion thereof. A controller is coupled to the fuser assembly and is operative to control a fusing temperature of the heat transfer member during a fusing operation when a temperature sensed by the temperature sensor falls outside a predetermined range by gradually changing a set-point temperature for at least one of the first and second resistive traces from an initial set-point temperature to an adjusted set-point temperature such that an amount of heat generated by the at least one of the first and second resistive traces is adjusted without changing a fusing speed of the fuser assembly.

20 Claims, 6 Drawing Sheets

(56) References Cited

U.S. PATENT DOCUMENTS

2008/0031652 A1* 2/2008 Yoda ..... G03G 15/5004 399/94
2009/0074442 A1* 3/2009 Sano ..... G03G 15/5004 399/69
2009/0123171 A1* 5/2009 Takahashi ..... G03G 15/5004 399/69
2009/0196643 A1* 8/2009 Mito ..... G03G 15/5004 399/69
2010/0086324 A1* 4/2010 Smith ..... G03G 15/2053 399/67
2010/0142986 A1* 6/2010 Davidson ..... G03G 15/2042 399/69
2010/0316404 A1* 12/2010 Fukuzawa ..... G03G 15/205 399/69
2010/0329719 A1* 12/2010 Hashiguchi ..... G03G 15/50 399/68
2011/0299868 A1* 12/2011 Ito ..... G03G 15/2039 399/69
2012/0051807 A1* 3/2012 Tress ..... G03G 15/2053 399/328
2012/0141155 A1* 6/2012 Suzumi ..... G03G 15/5004 399/70
2013/0026154 A1* 1/2013 Taniguchi ..... G03G 15/2053 219/385
2013/0071134 A1* 3/2013 Hikari ..... G03G 15/80 399/88
2013/0322897 A1* 12/2013 Yago ..... G03G 15/2053 399/33
2014/0056606 A1* 2/2014 Hasegawa ..... G03G 15/2039 399/67
2014/0076878 A1* 3/2014 Shimura ..... G03G 15/2042 219/216
2014/0133880 A1* 5/2014 Otsuka ..... G03G 15/2078 399/70
2014/0169845 A1* 6/2014 Nakahara ..... G03G 15/2053 399/328
2015/0030345 A1* 1/2015 Murakami ..... G03G 15/2039 399/69
2015/0086231 A1* 3/2015 Bush ..... G03G 15/2042 399/69
2015/0316879 A1* 11/2015 Koyama ..... G03G 15/2039 399/69
2016/0238974 A1* 8/2016 Kadowaki ..... G03G 15/2039
2016/0378052 A1* 12/2016 Kosaka ..... G03G 15/2039 399/88
2017/0023894 A1* 1/2017 Cao ..... G03G 15/2039

* cited by examiner

SYSTEM AND METHOD FOR CONTROLLING A FUSER ASSEMBLY OF AN ELECTROPHOTOGRAPHIC IMAGING DEVICE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to controlling a fuser assembly in an electrophotographic imaging device, and particularly to controlling temperature levels in the fuser assembly to allow for media sheets to be printed at full speed without overheating any portion of the fuser assembly.

2. Description of the Related Art

In an electrophotographic (EP) imaging process used in printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter the toner image is transferred to a media sheet intended to receive the final image. The toner image is fixed to the media sheet by the application of heat and pressure in a fuser assembly. The fuser assembly may include a heated roll and a backup roll forming a fuser nip through which the media sheet passes. Alternatively, the fuser assembly may include a fuser belt, a heater disposed within the belt around which the belt rotates, and an opposing backup member, such as a backup roll.

In a belt fusing system, an endless belt surrounds a ceramic heater element. The belt is pushed against the heater element by a pressure roller to create a fusing nip. To be able to fuse the widest media that the printer is designed to print, the length of the heating region is typically about the same width or slightly longer than the width of the widest media supported by the printer. The fusing heat is typically controlled by measuring the temperature of the heating region with a thermistor held in intimate contact with the ceramic heater element and feeding the temperature information to a microprocessor-controlled power supply in the printer, which in turn applies power to the heater element when the temperature drops below a first predetermined level, and which interrupts power when the temperature exceeds a second predetermined level. In this way, the fuser is maintained within an acceptable range of fusing temperatures.

When a to-be-printed media sheet has a width narrower than the width of the widest media supported by the printer, overheating problems may occur because the media sheet removes heat from the fuser only in the portion of the fuser contacting the media. As the portion of the fuser beyond the width of the media sheet does not lose any heat to the media sheet, such portion of the fuser becomes hotter than the portion contacting the media sheet and can be damaged due to high temperature.

As machine speeds increase, the tolerable range of media width variation at full speed becomes smaller. For example, in the case of printers operating at 60 pages per minute (ppm) and above, a media width difference of 3-4 mm may be enough to cause problematic overheating in the small portion of the fuser beyond the media. Since excessive thermal energy accumulated at the portion of the fuser not contacting the media (hereinafter "non-media portion") during narrow media printing can cause damage to the fuser, it is desirable to control the amount of thermal energy accumulated at the non-media portion to be below a certain level so that the fuser will not be damaged. To control the thermal energy accumulated at the non-media portion of the fuser, prior attempts used sensors to detect the temperature at the non-media portion. If the detected temperature exceeds a threshold, process speed is typically reduced and/or the interpage gap is increased to limit the overheating of the non-media portion. By doing so, however, throughput of the printer is reduced leading to reduced performance levels.

Accordingly, there is a need for an improved system for controlling thermal energy in a fuser assembly to avoid overheating while still improving performance in terms of throughput.

SUMMARY

Embodiments of the present disclosure provide systems and methods for regulating an amount of heat generated at an edge portion of a heater of a fuser assembly that would allow for an image forming device to print more media sheets at full speed.

In one example embodiment, an apparatus includes a fuser assembly including a heat transfer member and a backup member positioned to engage the heat transfer member to form a fusing nip therewith. The heat transfer member includes a substrate, a first resistive trace and a second resistive trace disposed on the substrate and running along a length thereof, and a temperature sensor disposed on the substrate for sensing an end portion of the substrate. The temperature sensor is positioned between a first location corresponding to a location in the fusing nip which an edge portion of a sheet of a first media size contacts when passing through the fusing nip and a second location corresponding to a location in the fusing nip which is contacted by an edge portion of a sheet of a second media size greater than the first media size when passing through the fusing nip. A controller is coupled to the temperature sensor and the first and second resistive traces of the fuser assembly. The controller is operative to control a fusing temperature of the heat transfer member during a fusing operation when a temperature sensed by the temperature sensor falls outside a predetermined range by gradually changing a set-point temperature for at least one of the first and second resistive traces from an initial set-point temperature to an adjusted set-point temperature such that an amount of heat generated by the at least one of the first and second resistive traces is adjusted without changing a fusing speed of the fuser assembly.

In an example embodiment, when the temperature sensed exceeds a predetermined threshold, the controller regulates an amount of heat between the first and second locations on the substrate by gradually reducing the initial set-point temperature for the first resistive trace until a corresponding adjusted set-point temperature for the first resistive trace is reached and gradually increasing the initial set-point temperature for the second resistive trace until a corresponding adjusted set-point temperature for the second resistive trace is reached. When the temperature sensed falls below a predetermined threshold, the controller the gradually increases the initial set-point temperature for the first resistive trace until an adjusted set-point temperature for the first resistive trace is reached to increase an amount of heat generated between the first and second locations on the substrate.

In another example embodiment, a method of controlling a fuser in an imaging apparatus during a fusing operation, the fuser including a heater member having a first resistive trace and a second resistive trace running parallel to each other relative to a fuser nip of the fuser, includes setting at least one set-point temperature for the first resistive trace and the second resistive trace, controlling each of the first and second resistive traces to generate an amount of heat based on a corresponding set-point temperature therefor, and detecting a temperature of the heater member at an edge portion thereof. The method further includes changing the set-point temperature for the first resistive trace to a first adjusted set-point temperature and changing the set-point temperature for the second resistive trace to a second adjusted set-point temperature different from the first adjusted set-point temperature when the detected temperature exceeds a first predetermined threshold, and controlling each of the first and second resistive traces to generate an adjusted amount of heat based on the first and second adjusted set-point temperatures, respectively.

BRIEF DESCRIPTION OF THE DRAWINGS

The above-mentioned and other features and advantages of the disclosed example embodiments, and the manner of attaining them, will become more apparent and will be better understood by reference to the following description of the disclosed example embodiments in conjunction with the accompanying drawings, wherein.

DETAILED DESCRIPTION

Figure 1:
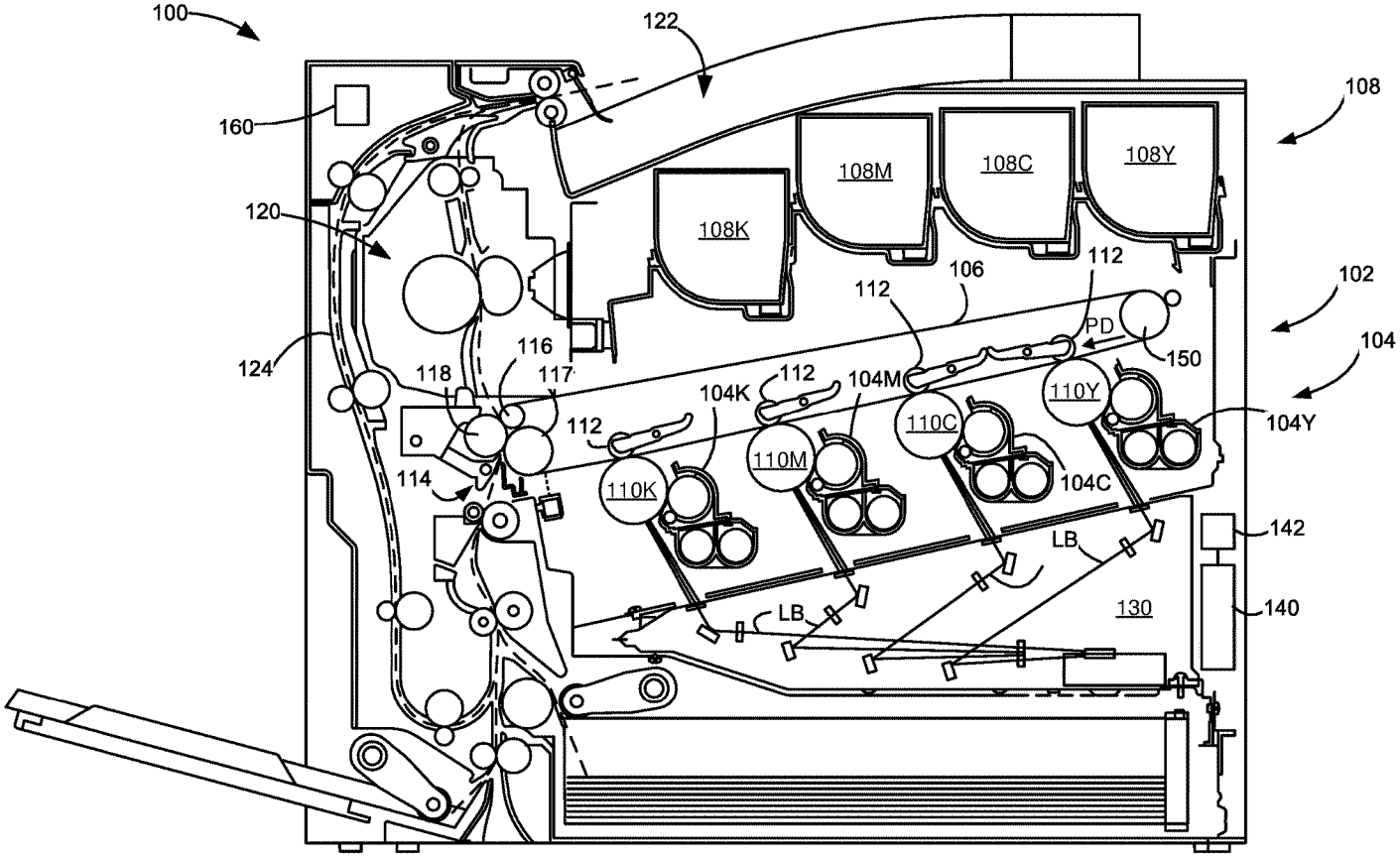
FIG. 1 is a schematic illustration of an imaging device including a fuser assembly according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

FIG. 1 illustrates a color imaging device 100 according to an example embodiment. Imaging device 100 includes a first toner transfer area 102 having four developer units 104Y, 104C, 104M and 104K that substantially extend from one end of imaging device 100 to an opposed end thereof. Developer units 104 are disposed along an intermediate transfer member (ITM) 106. Each developer unit 104 holds a different color toner. The developer units 104 may be aligned in order relative to a process direction PD of the ITM belt 106, with the yellow developer unit 104Y being the most upstream, followed by cyan developer unit 104C, magenta developer unit 104M, and black developer unit 104K being the most downstream along ITM belt 106.

Each developer unit 104 is operably connected to a toner reservoir 108 for receiving toner for use in a printing operation. Each toner reservoir 108Y, 108C, 108M and 108K is controlled to supply toner as needed to its corresponding developer unit 104. Each developer unit 104 is associated with a photoconductive member 110Y, 110C, 110M and 110K that receives toner therefrom during toner development in order to form a toned image thereon. Each photoconductive member 110 is paired with a transfer member 112 for use in transferring toner to ITM belt 106 at first transfer area 102.

During color image formation, the surface of each photoconductive member 110 is charged to a specified voltage, such as −800 volts, for example. At least one laser beam LB from a printhead or laser scanning unit (LSU) 130 is directed to the surface of each photoconductive member 110 and discharges those areas it contacts to form a latent image thereon. In one embodiment, areas on the photoconductive member 110 illuminated by the laser beam LB are discharged to approximately −100 volts. The developer unit 104 then transfers toner to photoconductive member 110 to form a toner image thereon. The toner is attracted to the areas of the surface of photoconductive member 110 that are discharged by the laser beam LB from LSU 130.

ITM belt 106 is disposed adjacent to each of developer unit 104. In this embodiment, ITM belt 106 is formed as an endless belt disposed about a backup roll 116, a drive roll 117 and a tension roll 150. During image forming or imaging operations, ITM belt 106 moves past photoconductive members 110 in process direction PD as viewed in FIG. 1. One or more of photoconductive members 110 applies its toner image in its respective color to ITM belt 106. For monocolor images, a toner image is applied from a single photoconductive member 110K. For multi-color images, toner images are applied from two or more photoconductive members 110. In one embodiment, a positive voltage field formed in part by transfer member 112 attracts the toner image from the associated photoconductive member 110 to the surface of moving ITM belt 106.

ITM belt 106 rotates and collects the one or more toner images from the one or more developer units 104 and then conveys the one or more toner images to a media sheet at a second transfer area 114. Second transfer area 114 includes a second transfer nip formed between back-up roll 116, drive roll 117 and a second transfer roller 118. Tension roll 150 is disposed at an opposite end of ITM belt 106 and provides suitable tension thereto.

Fuser assembly 120 is disposed downstream of second transfer area 114 and receives media sheets with the unfused toner images superposed thereon. In general terms, fuser assembly 120 applies heat and pressure to the media sheets in order to fuse toner thereto. After leaving fuser assembly 120, a media sheet is either deposited into an output media area 122 or enters a duplex media path 124 for transport to second transfer area 114 for imaging on a second surface of the media sheet.

Imaging device 100 is depicted in FIG. 1 as a color laser printer in which toner is transferred to a media sheet in a two-step operation. Alternatively, imaging device 100 may be a color laser printer in which toner is transferred to a media sheet in a single-step process—from photoconductive members 110 directly to a media sheet. In another alternative embodiment, imaging device 100 may be a monochrome laser printer which utilizes only a single developer unit 104 and photoconductive member 110 for depositing black toner directly to media sheets. Further, imaging device 100 may be part of a multi-function product having, among other things, an image scanner for scanning printed sheets.

Imaging device 100 further includes a controller 140 and memory 142 communicatively coupled thereto. Though not shown in FIG. 1, controller 140 may be coupled to components and modules in imaging device 100 for controlling same. For instance, controller 140 may be coupled to toner reservoirs 108, developer units 104, photoconductive members 110, fuser assembly 120 and/or LSU 130 as well as to motors (not shown) for imparting motion thereto. It is understood that controller 140 may be implemented as any number of controllers and/or processors for suitably controlling imaging device 100 to perform, among other functions, printing operations.

Still further, imaging device 100 includes a power supply 160. In one example embodiment, power supply 160 is a low voltage power supply which provides power to many of the components and modules of imaging device 100. Imaging device 100 may further include a high voltage power supply (not shown) for providing a high supply voltage to modules and components requiring higher voltages.

Figure 2:
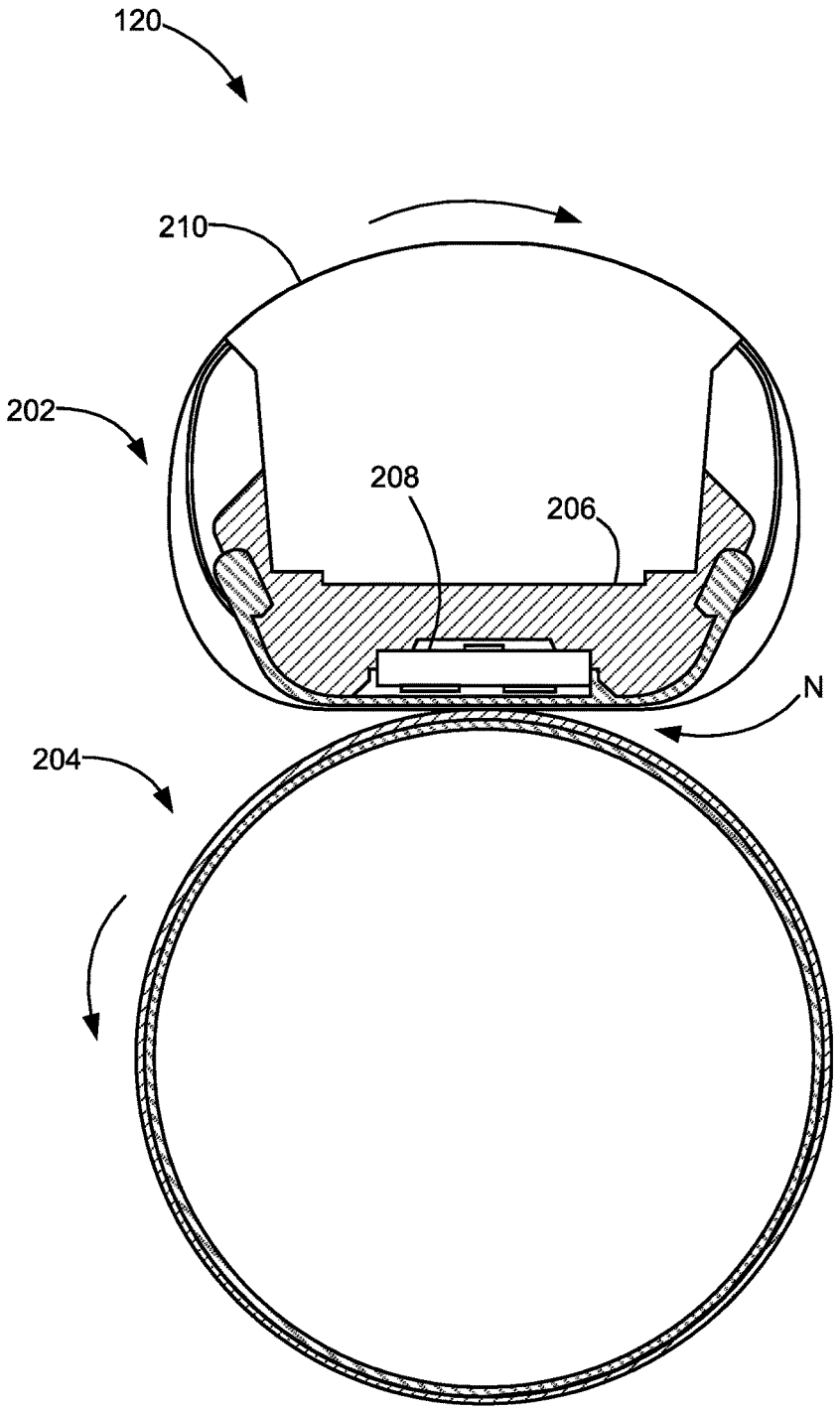
FIG. 2 is a cross sectional view of the fuser assembly in FIG. 1.

With respect to FIG. 2, in accordance with an example embodiment, there is shown fuser assembly 120 for use in fusing toner to sheets of media through application of heat and pressure. Fuser assembly 120 may include a heat transfer member 202 and a backup roll 204 cooperating with the heat transfer member 202 to define a fuser nip N for conveying media sheets therein. The heat transfer member 202 may include a housing 206, a heater member 208 supported on or at least partially in housing 206, and an endless flexible fuser belt 210 positioned about housing 206. Heater member 208 may be formed from a substrate of ceramic or like material to which at least one resistive trace is secured which generates heat when a current is passed through it. Heater member 208 may be constructed from the elements and in the manner as disclosed in U.S. patent application Ser. No. 14/866,278, filed Sep. 25, 2015, and assigned to the assignee of the present application, the content of which is incorporated by reference herein in its entirety. The inner surface of fuser belt 210 contacts the outer surface of heater member 208 so that heat generated by heater member 208 heats fuser belt 210. It is understood that, alternatively, heater member 208 may be implemented using other heat-generating mechanisms.

Fuser belt 210 is disposed around housing 206 and heater member 208. Backup roll 204 contacts fuser belt 210 such that fuser belt 210 rotates about housing 206 and heater member 208 in response to backup roll 204 rotating. With fuser belt 210 rotating around housing 206 and heater member 208, the inner surface of fuser belt 210 contacts heater member 208 so as to heat fuser belt 210 to a temperature sufficient to perform a fusing operation to fuse toner to sheets of media.

Fuser belt 210 and backup roll 204 may be constructed from the elements and in the manner as disclosed in U.S. Pat. No. 7,235,761, which is assigned to the assignee of the present application and the content of which is incorporated by reference herein in its entirety. It is understood, though, that fuser assembly 120 may have a different fuser belt architecture or even a different architecture from a fuser belt based architecture. For example, fuser assembly 120 may be a hot roll fuser, including a heated roll and a backup roll engaged therewith to form a fuser nip through which media sheets traverse. The hot roll fuser may include an internal or external heater member for heating the heated hot roll. The hot roll fuser may further include a backup belt assembly. Hot roll fusers, with internal and external heating forming the heat transfer member with the hot roll, and with or without backup belt assemblies, are known in the art and will not be discussed further for reasons of expediency.

Figure 3:
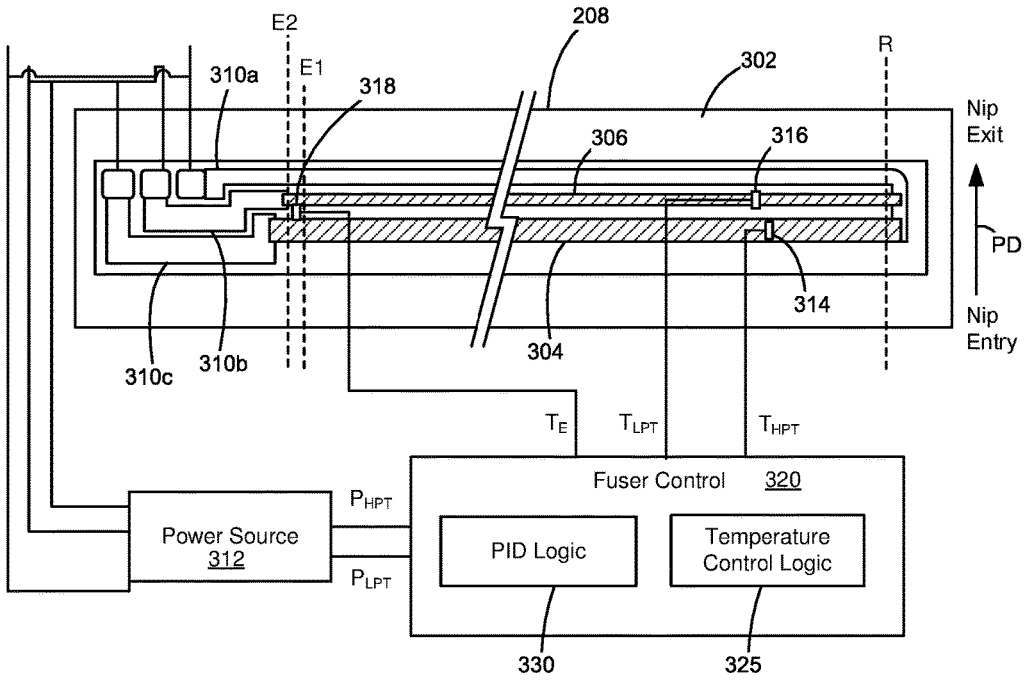
FIG. 3 is an illustrative view a heater member of the fuser assembly in FIG. 2 according to an example embodiment.

Referring now to FIG. 3, a fuser configuration is illustrated according to an example embodiment. In the example shown, heater member 208 is configured for a reference-edge based media feed system in which the media sheets are aligned in the media feed path of imaging device 100 using a side edge of each sheet. Heater member 208 includes a substrate 302 constructed from ceramic or other like material. Disposed on a bottom surface of substrate 302 in parallel relation with each other are two resistive traces 304 and 306. Resistive trace 304 is disposed on the entry side of fuser nip N and resistive trace 306 is disposed on the exit side of fuser nip N so that the process direction PD of fuser assembly 120 is illustrated in FIG. 3. Resistive traces 304, 306 are capable of generating heat when provided with electrical power. Heater member 208 further includes a plurality of conductors 310*a*, 310*b*, 310*c* connected to resistive traces 304, 306 to provide paths for current from a power source 312 to pass through resistive traces 304, 306. Power source 312 may draw power from one or more power supplies in imaging device 100.

In the example embodiment illustrated, resistive trace 304 has a length that is longer than a length of resistive trace 306. In an example embodiment, the length of resistive trace 304 is comparable to the width of a Letter sized sheet of media and is disposed on substrate 302 for fusing toner to Letter sized sheets. The length of resistive trace 306 is comparable to the width of A4 sized sheet of media and is disposed on substrate 302 for fusing toner to A4 sized sheets.

In an example embodiment, the width of resistive trace 304 is larger than the width of resistive trace 306 in order to have different heating zone requirements for different print speeds. In an example embodiment, the width of resistive trace 304 is between about 4.5 mm and about 5.5 mm, such as 5 mm, and the width of resistive trace 306 is between about 2.0 mm and about 2.50 mm, such as 2.25 mm. In general terms, the width of resistive trace 304 is between about two and about three times the width of resistive trace 306. By having such a difference in trace widths, and with the resistivity of resistive trace 304 being substantially the same as the resistivity of resistive trace 304 such that the resistance of trace 304 is less than the resistance of trace 306, resistive trace 304 may be used for lower printing speeds and both resistive traces 304 and 306 may be used for relatively high printing speeds.

In an example embodiment, resistive traces 304, 306 have different power ratings. In an example embodiment, resistive trace 304, hereinafter referred to as high power trace (HPT) 304, has a power level of about 1000 W and resistive trace 306, hereinafter referred to as low power trace (LPT) 306, has a power level of about 500 W. A fuser control block 320 controls power source 312 to control the current passing through, and hence the power level of, each resistive trace 304 and 306. Fuser control block 320 may be implemented in controller 140 and employ one or more fuser control methods such as proportional-integral-derivative (PID) control to control heat generation by heater member 208. Alternatively, fuser control block 320 may be provided separately from controller 140. In an example embodiment, resistive traces 304, 306 are controlled independently from one another by fuser control block 320.

Fusing temperature for fusing media sheets may be controlled by measuring the temperature of one or more regions of substrate 302 using a plurality of temperature sensors held in contact therewith and feeding the temperature information to fuser control block 320 which in turn controls power source 312 to apply power to heater member 208 based on the temperature information. In the example shown, a plurality of thermistors including a first thermistor 314 is disposed on a top surface of substrate 302 opposite an area of resistive trace 304 near the length-wise end of resistive trace 304 that corresponds to the reference edge R of a sheet of media passing through fuser nip N. First thermistor 314 is used for sensing the temperature of the substrate region that is directly heated by high power trace 304 and controlling the amount of heat generated thereby. Similarly, a second thermistor 316 is disposed on the top surface of substrate 302 opposite resistive trace 306 near the length-wise end of resistive trace 306 that corresponds to the reference edge R of the sheet of media. Second thermistor 316 is used for sensing the temperature of the substrate region directly heated by low power trace 306 and controlling the amount of heat generated thereby.

A third thermistor, edge thermistor 318, is disposed on the top surface of substrate 302 opposite an area of heater member 208 that does not contact A4 media but contacts Letter sized media. In the example shown, line E1 corresponds a location in fuser nip N which the non-reference edge of A4 media contacts when passing through fuser nip N while line E2 corresponds to a location in fuser nip N which the non-reference edge of Letter media contacts when passing through fuser nip N and which is not contacted by the non-reference edge of A4 media when passing through fuser nip N. Edge thermistor 318 is positioned at a location beyond line E1, such as between lines E1 and E2, and is used for sensing the temperature a substrate region beyond the non-reference edge of A4 sized media. In one example embodiment, edge thermistor 318 may be positioned about halfway between lines E1 and E2, such as about 3 mm from line E1. In the example embodiment or in another example embodiment, edge thermistor 318 is positioned between first thermistor 314 and second thermistor 316 relative to the process direction PD such that edge thermistor 318 is disposed at a substrate region that is not directly heated by resistive traces 304, 306 (i.e., between the substrate regions directly heated by resistive traces 304, 306). In this way, the temperature sensed by edge thermistor 318 is based on heat contributions from both resistive traces 304, 306 and thus varies with the temperature sensed by each of the first and second thermistors 304, 306. It will be appreciated that thermistors 314, 316 and 318 are superimposed on resistive traces 304, 306 in FIG. 3 for reasons of simplicity and clarity, and it is understood that the thermistors are disposed on a surface of heater member 208 opposite the surface along which resistive traces 304, 306 are disposed. By having thermistors disposed on substrate 302 in this way, resistive traces 304, 306 may be independently controlled so that heater member 208 achieves a more uniform temperature profile from nip entry to nip exit of fuser nip N.

Fuser control block 320 is coupled to outputs of thermistors 314, 316 and 318 and controls power source 312 to supply power to heater member 208 according to temperature feedback from thermistors 314, 316 and 318. In the example illustrated, fuser control block 320 includes a temperature control logic block 325 and a PID logic block 330. Temperature control logic block 325 generally provides temperature reference values for setting the set-point temperatures for resistive traces 304, 306 based at least on temperature feedback from first thermistor 314, second thermistor 316, and edge thermistor 318. The set-point temperatures are used to set the target temperature for one or more substrate regions of substrate 302. Based on the set-point temperatures from temperature control logic block 325 and temperature feedback from thermistors 314, 316, and 318, PID logic block 330 determines the power level for each resistive trace 304, 306. Fuser control block 320, using PID logic block 330 and attendant electronics (not shown), provides output signals $P_{HPT}$, $P_{LPT}$ indicating power levels for high power trace 304 and low power trace 306, respectively, as inputs to power source 312. In turn, power source 312 independently controls the amount of current passing through high power trace 304 and low power trace 306 based on the output signals $P_{HPT}$ and $P_{LPT}$, respectively, to control the amount of heat generated thereby.

In use, both resistive traces 304, 306 are turned on by passing current through them such that both resistive traces 304, 306 generate heat during a fusing operation. Fuser control block 320 controls power source 312 to provide electrical power to both high power trace 304 and low power trace 306 via conductors 310*a*, 310*b*, 310*c* for heating heater member 208. When fusing A4 sized media with both resistive traces 304, 306 turned on, the fuser portion beyond line E1 may accumulate excessive thermal energy that may otherwise cause overheating due to the media sheet passing through fuser nip N and absorbing heat energy only within the fuser portion contacted by the A4 media sheet. On the other hand, when fusing Letter sized media with both resistive traces 304, 306 turned on, temperature of the fuser portion beyond line E1 may drop to a level that may cause insufficient fusing due to absorption of heat by the non-reference edge portion of the media sheet contacting the fuser portion beyond line E1.

In order to prevent overheating when printing A4 sized media or insufficient toner fusing when printing Letter sized media while both resistive traces 304, 306 are turned on during printing, fuser control block 320 utilizes temperature feedback from edge thermistor 318 to control or regulate the amount of heat in the fuser portion beyond line E1 by adjusting the heating power contributions of high power trace 304 and low power trace 306 at the fuser portion beyond line E1 without slowing down printing and/or fusing speed and/or without changing the inter-page gap between media sheets. In particular, fuser control block 320 monitors temperature feedback from edge thermistor 318 and adjusts the set-point temperature for at least one of high power trace 304 and low power trace 306 when the detected edge temperature of the fuser portion beyond line E1 falls outside a predetermined range in order to control the amount of heat generated by each resistive trace 304, 306 and, consequently, the amount of heat generated in the fuser portion beyond line E1. The set-point temperature adjustments for resistive traces 304, 306 are selected such that while the amount of heat generated in the fuser portion beyond line E1 is regulated, temperature of the fuser portion contacted by the media sheet is substantially kept within a desired range of fusing temperature levels so as not to cause overheating or underheating thereof.

As an example, a predetermined range of acceptable temperatures for the fuser portion beyond line E1, which is used to determine when to perform set-point temperature adjustments for at least one of high power trace 304 and low power trace 306, may be defined by a first predetermined threshold $TH_1$ and a second predetermined threshold $TH_2$ greater than the first predetermined threshold $TH_1$. When printing Letter sized media and the temperature sensed by edge thermistor 318 falls below the first predetermined threshold $TH_1$, the amount of heat generated at the fuser portion beyond line E1 is increased by increasing the power level of high power trace 304 to generate more heat beyond line E1 and avoid insufficient fusing at the non-reference edge portion of the Letter sized media sheet. On the other hand, when printing A4 sized media and the temperature sensed by edge thermistor 318 exceeds the second predetermined threshold $TH_2$, the amount of heat generated at the fuser portion beyond line E1 and/or the accumulation of heat thereat is decreased by reducing the power level of high power trace 304 and increasing the power level of low power trace 306 in order to mitigate overheating and/or slow down the accumulation of heat so that more sheets of A4 media may be printed. As more sheets of A4 media are printed after the power level adjustments for resistive traces 304, 306, the fuser portion beyond line E1 may slowly accumulate heat. Once the temperature sensed by edge thermistor 318 exceeds a third predetermined threshold $TH_3$ greater than the second predetermined threshold $TH_2$, printing and/or fusing speed is reduced to avoid fuser damage.

Figure 4:
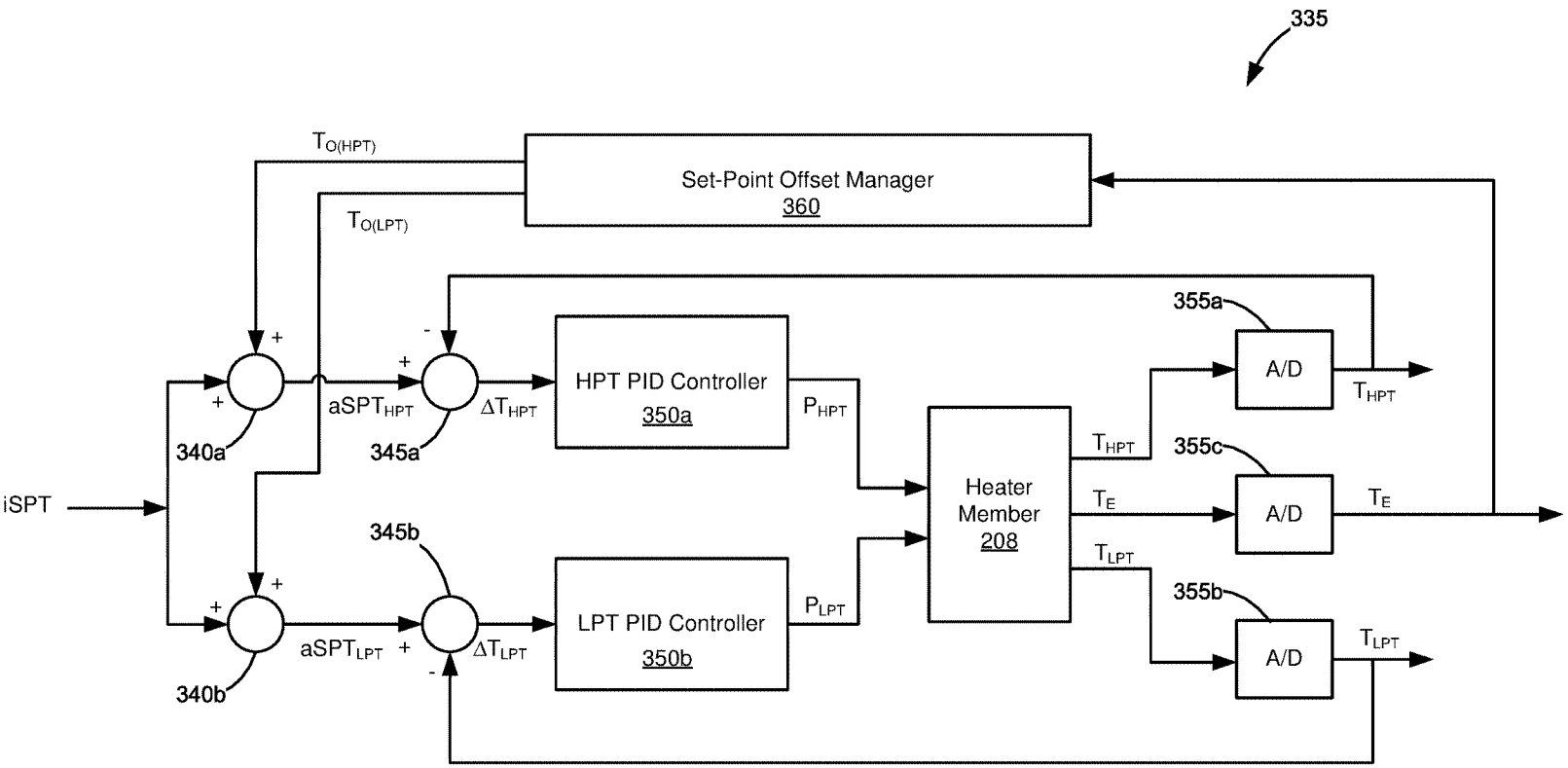
FIG. 4 illustrates a control system for controlling the heater member in FIG. 3 according to an example embodiment.

With reference to FIG. 4, a block diagram of an example form of a closed loop control system 335 that is used to control heater member 208 is shown. During a printing operation, a set-point temperature (SPT), which is provided by temperature control logic block 325, is set for each of high power trace 304 and low power trace 306 to generate an amount of heat for fusing media sheets. In one example embodiment, high power trace 304 and low power trace 306 may have the same initial set-point temperature iSPT, such as about 235° C. In an alternative example embodiment, high power trace 304 and low power trace 306 may have different initial set-point temperatures. The initial set-point temperature(s) iSPT may be determined based on media process speed and/or media type. In the example shown, initial set-point temperature iSPT is separated out and fed through nodes 340*a*, 340*b*, nodes 345*a*, 345*b* and into HPT PID controller 350*a* for high power trace 304 and LPT PID controller 350*b* for low power trace 306, respectively. PID controllers 350*a*, 350*b* are implemented in PID logic block 330. Outputs $P_{HPT}$ and $P_{LPT}$ of PID controllers 350*a*, 350*b*, respectively, are used to control heat generation in heater member 208, and more particularly the amount of heat generated by high power trace 304 and low power trace 306, respectively.

The actual edge temperature $T_E$ sensed by edge thermistor 318 in heater member 208 is received by a corresponding analog-to-digital (A/D) converter 355*c* and is fed to a Set-Point Offset Manager 360 implemented in temperature control logic block 325. Set-Point Offset Manager 360 has two outputs $T_{O(HPT)}$, $T_{O(LPT)}$ which are connected to nodes 340*a*, 340*b*, respectively, and indicating set-point temperature adjustments for high power trace 304 and low power trace 306, respectively, based on the edge temperature $T_E$ sensed by edge thermistor 318. In one example, outputs $T_{O(HPT)}$, $T_{O(LPT)}$ are temperature offset values that are used to either increase or decrease the set-point temperature SPT values outputted by nodes 304*a*, 304*b*, respectively. In particular, each node 340*a*, 340*b* also receives as input the initial set-point temperature iSPT and outputs a corresponding adjusted set-point temperature aSPT for each of high power trace 304 and low power trace 306, respectively, based on the temperature offset value provided by Set-Point Offset Manager 360. In an example embodiment, Set-Point Offset Manager 360 gradually changes the temperature offset values $T_O$ until the adjusted set-point temperature aSPT for each resistive trace 304, 306 reaches a predetermined value. By adjusting the set-point temperature in a gradual manner, instances of overshoot and undershoot of resistive trace temperature may be substantially avoided or otherwise reduced.

As an example, when edge temperature $T_E$ increases substantially continuously during printing and exceeds the second predetermined threshold $TH_2$, such as about 240° C., Set-Point Offset Manager 360 may detect that the media sheet being printed is narrower than Letter media and adjust the set-point temperature for each of high power trace 304 and low power trace 306 by a predetermined value in order to reduce the amount of heat generated at the fuser portion beyond line E1. In an example embodiment, Set-Point Offset Manager 360 gradually reduces the set-point temperature for high power trace 304 by providing a negative temperature offset value $T_{O(HPT)}$ into node 340*a* until a final adjusted set-point temperature $aSPT_{HPT}$, such as about 215° C. is reached. In this example, the final adjusted set-point temperature $aSPT_{HPT}$ for high power trace 304 is 20° C. less than the initial set-point temperature iSPT of 235° C. In addition to reducing the set-point temperature for high power trace 304, Set-Point Offset Manager 360 gradually increases the set-point temperature for low power trace 306 by providing a positive temperature offset value $T_{O(LPT)}$ into node 340*b* until a final adjusted set-point temperature $aSPT_{LPT}$, such as about 250° C., for low power trace 306 is reached. In this example, the final adjusted set-point temperature $aSPT_{LPT}$ for low power trace 306 is 15° C. greater than the initial set-point temperature iSPT of 235° C.

In another example, when temperature $T_E$ decreases substantially continuously during printing and falls below the first predetermined threshold $TH_1$, such as about 210° C., Set-Point Offset Manager 360 may detect that the media sheet being printed is wider than A4 media and adjust the set-point temperature for at least one of the high power trace 304 and low power trace 306 by a predetermined value in order to increase the amount of heat generated at the fuser portion beyond line E1. In an example embodiment, Set-Point Offset Manager 360 gradually increases the set-point temperature for high power trace 304 by providing a positive temperature offset value $T_{O(HPT)}$ into node 340*a* until a final adjusted set-point temperature $aSPT_{HPT}$, such as about 245° C., is reached. In this example, the final adjusted set-point temperature $aSPT_{HPT}$ for high power trace 304 is 10° C. more than the initial set-point temperature iSPT of 235° C. In an example embodiment, Set-Point Offset Manager 360 adjusts the set-point temperature for high power trace 304 without changing the set-point temperature for low power trace 306 to increase the amount of heat generated at the fuser portion beyond line E1. It will be appreciated, though, that Set-Point Offset Manager 360 may perform adjustments on the set-point temperature for low power trace 306, such as to decrease the final adjusted set-point temperature $aSPT_{LPT}$ thereof, in other alternative embodiments.

The actual temperatures sensed by first (HPT) thermistor 314 and second (LPT) thermistor 316 are fed into respective A/D converters 355*a*, 355*b* which in turn feed the digitized values corresponding to sensed temperatures $T_{HPT}$, $T_{LPT}$ back to nodes 345*a*, 345*b*, respectively. Each node 345*a*, 345*b* also receives corresponding adjusted set-point temperature $aSPT_{HPT}$, $aSPT_{LPT}$ for high power trace 304 and low power trace 306, respectively. As set-point temperature adjustments are performed, each node 345*a*, 345*b* outputs a corresponding error signal ΔT representing a difference between the detected sensed temperatures $T_{HPT}$, $T_{LPT}$ and the corresponding adjusted set-point temperature aSPT. PID controllers 350*a*, 350*b* then control heat generation in heater member 208 based on error signals $\Delta T_{HPT}$, $\Delta T_{LPT}$, respectively, by adjusting the power level of each of high power trace 304 and low power trace 306 until the detected temperatures $T_{HPT}$, $T_{LPT}$ substantially equal respective adjusted set-point temperatures $aSPT_{HPT}$, $aSPT_{LPT}$ therefor.

The rates at which the set-point temperatures for high power trace 304 and low power trace 306 change may be based on any desired condition or parameter. In one example embodiment, the rate of change of a set-point temperature to reach the final adjusted set-point temperature may depend on the maximum amount of temperature offset desired. In the above example where edge temperature $T_E$ exceeds the second predetermined threshold $TH_2$ of 240° C., the maximum amount of temperature offset for high power trace 304 is 20° C. (which is subtracted from than the initial set-point temperature iSPT) and that of low power trace 306 is 15° C. (which is added to the initial set-point temperature iSPT) such that the SPT change rates for high power trace 304 and low power trace 306 to reach the final adjusted set-point temperatures may vary. In other alternative embodiments, the set-point temperatures for high power trace 304 and low power trace 306 may change at the same rate.

Figure 5:
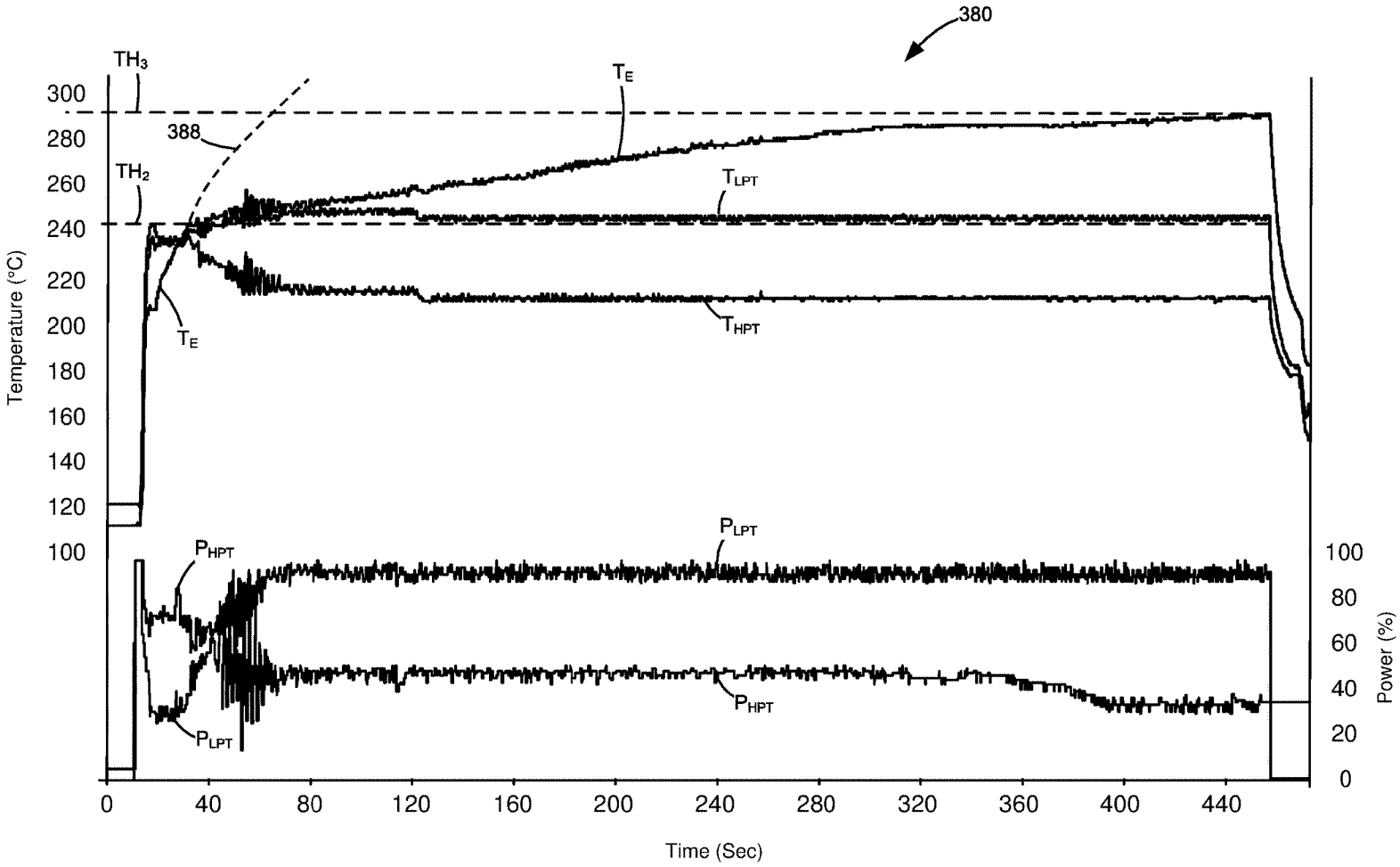
FIG. 5 is a chart illustrating an example temperature response of the heater member when using the control system in FIG. 4.

FIG. 5 illustrates an example chart 380 showing the temperature response of heater member 208 when using control system 335 during printing of A4 sized media at 70 ppm. It is noted that chart 380 is a representative model provided to facilitate understanding of the present disclosure and thus should not be considered limiting. In the example shown, edge temperature $T_E$ sensed by edge thermistor 318 is plotted as curve $T_E$, while temperature readings $T_{HPT}$, $T_{LPT}$ for high power trace 304 and low power trace 306 are plotted as curves $T_{HPT}$, $T_{LPT}$, respectively. Corresponding power levels of high power trace 304 and low power trace 306 are also illustrated as curves $P_{HPT}$, $P_{LPT}$, respectively. For the first 25 sheets of A4 sized media being printed at 70 ppm (e.g., at approximately 21 seconds in chart 380), high power trace 304 and low power trace 306 have substantially the same temperature of about 235° C. At this point, the power level $P_{HPT}$ of high power trace 304 is around 70% and the power level $P_{LPT}$ of low power trace 306 is around 28%. Since no heat is removed by A4 media in the fuser portion beyond its non-reference edge (i.e., beyond line E1), the edge temperature $T_E$ quickly rises to the second predetermined threshold $TH_2$ of about 240° C. If the set-point temperatures for resistive traces 304, 306 are not adjusted, edge temperature $T_E$ would follow the dashed curve 388 and quickly overheat at about 300° C. after a few more A4 media sheets, such as around 40 to 50 sheets, are printed. In order to avoid fuser damage, the temperature $T_{HPT}$ of high power trace 304 is gradually reduced until it reaches about 215° C. by gradually reducing the power level of high power trace from about 70% to about 45%, and the temperature $T_{LPT}$ of low power trace 306 is gradually increased until it reaches about 245° C. by gradually increasing the power level of low power trace 306 from about 28% to about 90%. Because of the temperature adjustments, the rate at which edge temperature $T_E$ rises after printing the first 25 sheets is decreased such that more sheets of A4 media are printed before the edge temperature $T_E$ overheats, which in this case may be at about 300° C. In one example embodiment, the printing speed may be slowed down, such as from 70 ppm to 50 ppm, when the edge temperature $T_E$ reaches the third predetermined threshold $TH_3$, such as at about 290° C., to avoid fuser damage.

Figure 6:
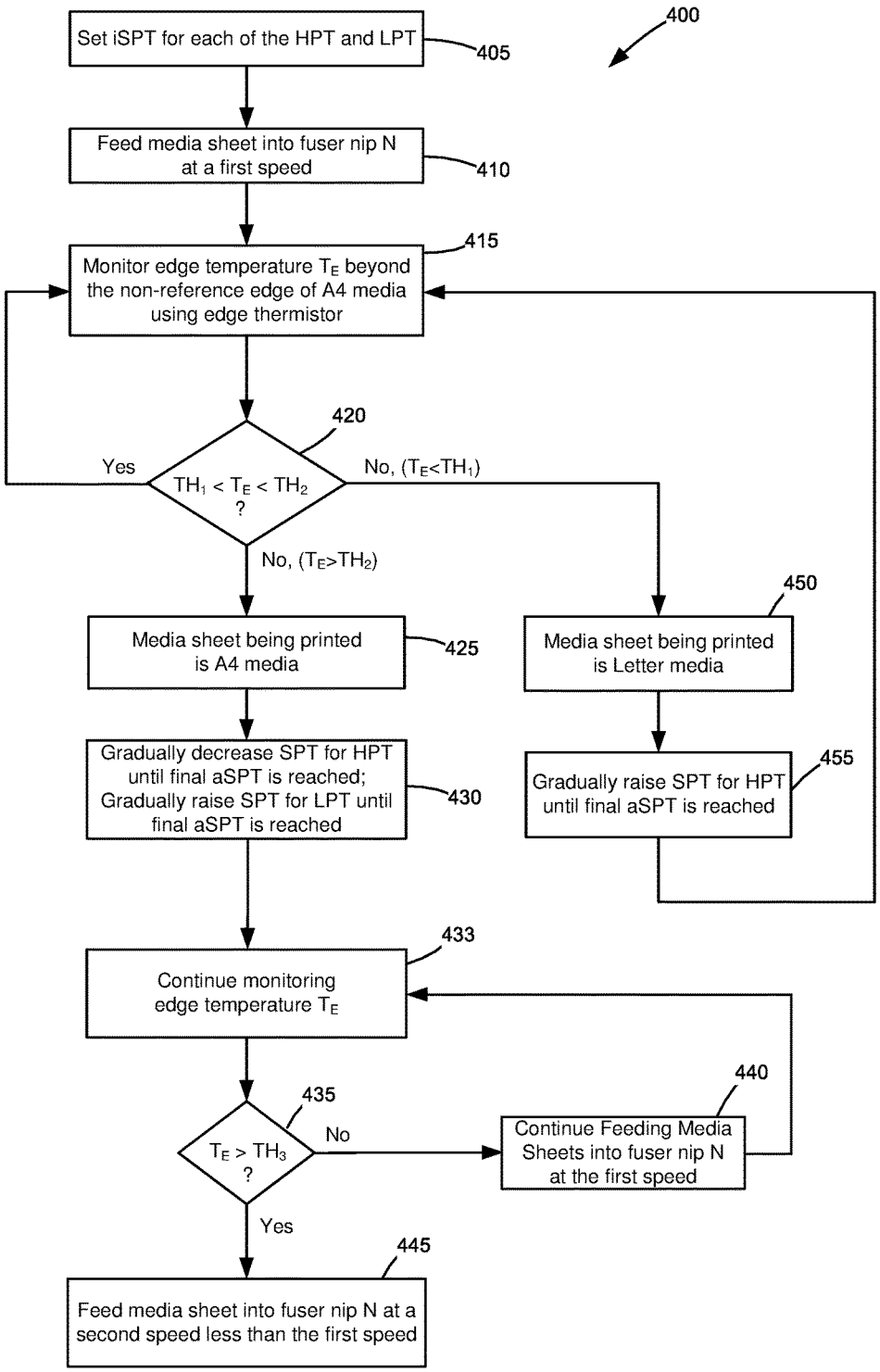
FIG. 6 is a flowchart of an example method for controlling the fuser assembly of FIG. 2 according to an example embodiment.

Referring now to FIG. 6, an example method 400 for controlling heater member 208 during a printing operation is illustrated according to an example embodiment. At block 405, initial set point temperatures for high power trace 304 and low power trace 306 are set. Each of resistive traces 304, 306 generates an amount of heat based on its corresponding SPT. Media sheets pass through fuser nip N at a first speed at block 410. As media sheets are fused, edge temperature $T_E$ of the substrate region beyond line E1 is monitored using edge thermistor 318 at block 415. At block 420, a determination is made as to whether the edge temperature $T_E$ is within an acceptable range of fusing temperature levels defined by first predetermined threshold $TH_1$ and second predetermined threshold $TH_2$. On determining that the edge temperature $T_E$ is within the predetermined range, method 400 continues to monitor the edge temperature $T_E$ using edge thermistor 318.

When fusing A4 sized media, temperature of the fuser portion beyond line E1 may increase more rapidly due to the media sheet absorbing heat energy only within the width of A4 sized media sheet. When it is determined, at block 420, that the edge temperature $T_E$ has increased beyond the predetermined range and exceeded the second predetermined threshold $TH_2$, fuser control block 320 recognizes that the media sheets being printed comprise A4 media at block 425. Based upon the media width detected, the set point temperature for each of high power trace 304 and low power trace 306 is adjusted in order to reduce the amount of heat generated in the fuser portion beyond line E1 and mitigate overheating. In particular, at block 430, the set-point temperature for high power trace 304 is gradually reduced to decrease the power level thereof until the final desired adjusted set-point temperature for high power trace 304 is reached, and the set-point temperature for low power trace 306 is gradually raised to increase the power level thereof until the final desired adjusted set-point temperature for low power trace 306 is reached.

Media sheet feeding through fuser nip N at the first speed is continuously performed during and after the set-point temperature adjustments at block 430. As media sheet feeding continues, monitoring of the edge temperature $T_E$ is continued at block 433. At block 435, a determination is made as to whether the edge temperature $T_E$ has exceeded the third predetermined threshold $TH_3$. On determining that the edge temperature $T_E$ has not reached the third predetermined threshold $TH_3$, method 400 proceeds to block 440 to continue feeding media sheets at the first speed and continues to monitor the edge temperature $T_E$ at block 433. When it is determined, at block 435, that the edge temperature $T_E$ has exceeded the third predetermined threshold $TH_3$, feeding of media sheets into fuser nip N is slowed down to a second speed less than the first speed at block 445.

When fusing Letter sized media, temperature of the fuser portion beyond line E1 may drop due to heat absorption by the non-reference edge portion of Letter media sheet beyond line E1. When it is determined, at block 420, that the edge temperature $T_E$ has fallen outside the predetermined range and dropped below the first predetermined threshold $TH_1$, fuser control block 320 recognizes that the media sheets being printed comprise Letter media at block 450. Based upon the media width detected, the set-point temperature for high power trace 304 is adjusted in order to increase the amount of heat generated in the fuser portion beyond line E1 to avoid insufficient fusing at the non-reference edge portion of Letter media. In particular, at block 455, the set-point temperature for high power trace 304 is gradually raised to increase the power level thereof until the final desired adjusted set-point temperature for high power trace 304 is reached. Media sheet feeding through fuser nip N at the first speed is continuously performed during the set-point temperature adjustment at block 455. Thereafter, method 400 returns to block 415 to continue monitoring the edge temperature $T_E$.

The above example embodiments have been described with respect to a reference-edge media feed system where one side of the media sheet is in a substantially constant location within fuser assembly 120 regardless of the media width. It will be appreciated, however, that the concepts and applications described herein may also be used in center-referenced media feed systems where media sheets move at a center position along the media path and locations of both edges of the media sheet vary with media width. In addition, although illustrative examples of control configurations have been described relative to using A4 and Letter sized media, it is understood that applications of the present disclosure extend to using other media sheet sizes.

The foregoing description of several example embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An apparatus, comprising:

a fuser assembly including a heat transfer member and a backup member positioned to engage the heat transfer member to form a fusing nip therewith, the heat transfer member including:

a substrate;

a first resistive trace and a second resistive trace disposed on the substrate and running along a length thereof; and a temperature sensor disposed on the substrate for sensing an end portion of the substrate, the temperature sensor positioned between a first location corresponding to a location in the fusing nip which an edge portion of a sheet of a first media size contacts when passing through the fusing nip and a second location corresponding to a location in the fusing nip which is contacted by an edge portion of a sheet of a second media size greater than the first media size when passing through the fusing nip; and a controller coupled to the temperature sensor and the first and second resistive traces of the fuser assembly, the controller operative to control a fusing temperature of the heat transfer member during a fusing operation when a temperature sensed by the temperature sensor falls outside a predetermined range by gradually changing a set-point temperature for at least one of the first and second resistive traces from an initial set-point temperature to an adjusted set-point temperature such that an amount of heat generated by the at least one of the first and second resistive traces is adjusted without changing a fusing speed of the fuser assembly.

2. The apparatus of claim 1, wherein when the temperature sensed exceeds a predetermined threshold, the controller regulates an amount of heat between the first and second locations on the substrate by gradually reducing the initial set-point temperature for the first resistive trace until a corresponding adjusted set-point temperature for the first resistive trace is reached and gradually increasing the initial set-point temperature for the second resistive trace until a corresponding adjusted set-point temperature for the second resistive trace is reached.

3. The apparatus of claim 2, wherein the first resistive trace has a length that is greater than a length of the second resistive trace, the second resistive trace extending from a longitudinal end portion to the first location on the substrate and the first resistive trace extending from the longitudinal end portion to the second location on the substrate beyond a location corresponding to the temperature sensor.

4. The apparatus of claim 2, wherein the first resistive trace has a first power rating and the second resistive trace has a second power rating that is less than the first power rating, the adjusted set-point temperature for the first resistive trace being less than the adjusted set-point temperature for the second resistive trace.

5. The apparatus of claim 2, further comprising a second temperature sensor disposed on the substrate opposite a location covered by the first resistive trace and a third temperature sensor disposed on the substrate opposite a location covered by the second resistive trace, wherein the controller determines a power level for the first resistive trace based upon the adjusted set-point temperature for the first resistive trace and a temperature sensed by the second temperature sensor, and determines a power level for the second resistive trace based upon the adjusted set-point temperature for the second resistive trace and a temperature sensed by the third temperature sensor, the controller controlling an amount of power for each of the first and second resistive traces during the fusing operation based upon the determined power level therefor.

6. The apparatus of claim 5, wherein the controller controls the amount of power for the first and second resistive traces during the fusing operation independently of each other.

7. The apparatus of claim 1, wherein when the temperature sensed falls below a predetermined threshold, the controller the gradually increases the initial set-point temperature for the first resistive trace until an adjusted set-point temperature for the first resistive trace is reached to increase an amount of heat generated between the first and second locations on the substrate.

8. The apparatus of claim 7, wherein the controller gradually increases the initial set-point temperature for the first resistive trace without changing the set-point temperature for the second resistive trace.

9. An apparatus, comprising:

a fuser assembly including a heat transfer member and a backup member positioned to engage the heat transfer member to form a fusing nip therewith, the heat transfer member including:

a substrate;

a first resistive trace and a second resistive trace disposed on the substrate and running along a length thereof; and a temperature sensor disposed on the substrate and positioned on an end portion thereof between a first location corresponding to a location in the fusing nip which an edge portion of a sheet of a first media size contacts when passing through the fusing nip and a second location corresponding to a location in the fusing nip which is contacted by an edge portion of a sheet of a second media size greater than the first media size when passing through the fusing nip, the temperature sensor for sensing a temperature of the end portion of the substrate; and a controller coupled to the fuser assembly, wherein when a temperature sensed by the temperature sensor exceeds a predetermined threshold, the controller regulates an amount of heat on the end portion of the substrate between the first and second locations by gradually adjusting heat contributions of the first and second resistive traces on the end portion, the controller decreasing a set-point temperature for the first resistive trace to decrease an amount of heat contributed by the first resistive trace on the end portion and increasing a set-point temperature for the second resistive trace to increase an amount of heat contributed by the second resistive trace on the end portion.

10. The apparatus of claim 9, wherein the controller gradually decreases the set-point temperature for the first resistive trace and gradually increases the set-point temperature of the second resistive trace without changing a speed of media sheets passing through the fusing nip and without changing an interpage gap between adjacent media sheets.

11. The apparatus of claim 9, further comprising a second temperature sensor disposed on the substrate for sensing a temperature of a substrate region covered by the first resistive trace and a third temperature sensor disposed on the substrate for sensing a substrate region covered by the second resistive trace, wherein the controller controls an amount of power for the first resistive trace based upon the decreased set-point temperature for the first resistive trace and a temperature sensed by the second temperature sensor, and controls an amount of power for the second resistive trace based upon the increased set-point temperature for the second resistive trace and a temperature sensed by the third temperature sensor.

12. The apparatus of claim 11, wherein the controller controls the amount of power for the first and second resistive traces during the fusing operation independently of each other.

13. The apparatus of claim 9, wherein the second resistive trace extends from a longitudinal end portion to the first location on the substrate and the first resistive trace extends from the longitudinal end portion to the second location on the substrate beyond a location corresponding to the temperature sensor, the amount of heat generated at the end portion is reduced after adjusting the heat contributions of the first and second resistive traces on the end portion.

14. The apparatus of claim 9, wherein when the temperature sensed by the temperature sensor falls below a second predetermined threshold less than the predetermined threshold, the controller increases a set-point temperature for the first resistive trace to increase the amount of heat on the end portion of the substrate.

15. A method of controlling a fuser in an imaging apparatus during a fusing operation, the fuser including a heater member having a first resistive trace and a second resistive trace running parallel to each other relative to a fuser nip of the fuser, the method comprising:

setting at least one set-point temperature for the first resistive trace and the second resistive trace;

controlling each of the first and second resistive traces to generate an amount of heat based on a corresponding set-point temperature therefor;

detecting a temperature of the heater member at an edge portion thereof;

when the detected temperature exceeds a first predetermined threshold, changing the set-point temperature for the first resistive trace to a first adjusted set-point temperature and changing the set-point temperature for the second resistive trace to a second adjusted set-point temperature different from the first adjusted set-point temperature; and controlling each of the first and second resistive traces to generate an adjusted amount of heat based on the first and second adjusted set-point temperatures, respectively.

16. The method of claim 15, wherein the changing the set-point temperature for the first resistive trace includes gradually reducing the set-point temperature for the first resistive trace towards the first adjusted set-point temperature, and the changing the set-point temperature for the second resistive trace includes gradually raising the set-point temperature for the second resistive trace towards the second adjusted set-point temperature.

17. The method of claim 15, further comprising:

detecting a first temperature of a region of the heater member covered by the first resistive trace and a second temperature of a region of the heater member covered by the second resistive trace;

determining a power level for the first resistive trace based upon the first adjusted set-point temperature and the first temperature and a power level for the second resistive trace based upon the second adjusted set-point temperature and the second temperature; and controlling an amount of power for each of the first and second resistive traces during the fusing operation based upon the determined power level therefor.

18. The method of claim 17, wherein the controlling the amount of power for the first and second resistive traces during the fusing operation is performed independently of each other.

19. The method of claim 15, further comprising, when the detected temperature falls below a second predetermined threshold less than the first predetermined threshold, increasing the set-point temperature for the first resistive trace to a third adjusted set-point temperature without changing the set-point temperature for the second resistive trace.

20. The method of claim 15, wherein changing the respective set-point temperatures for the first and second resistive traces is performed without changing a fusing speed of the fuser during the fusing operation.

* * * * *